US008091566B2

(12) United States Patent
Salciarini

(10) Patent No.: US 8,091,566 B2
(45) Date of Patent: Jan. 10, 2012

(54) APPLICATOR FOR MAKING UP THE EYELASHES AND/OR THE EYEBROWS, THE APPLICATOR INCLUDING A FURROW

(75) Inventor: Christian Salciarini, Dames (FR)

(73) Assignee: Chanel Parfums Beaute, Neuilly-sur-Seine (FR)

( * ) Notice: Subject to any disclaimer, the term of this patent is extended or adjusted under 35 U.S.C. 154(b) by 650 days.

(21) Appl. No.: 12/170,650

(22) Filed: Jul. 10, 2008

(65) Prior Publication Data

US 2009/0014022 A1 Jan. 15, 2009

Related U.S. Application Data

(60) Provisional application No. 60/950,630, filed on Jul. 19, 2007.

(30) Foreign Application Priority Data

Jul. 11, 2007 (FR) ..... 07 56435

(51) Int. Cl.
*A45D 40/26* (2006.01)

(52) U.S. Cl. ..... 132/320; 132/218

(58) Field of Classification Search ..... 132/218, 132/318, 320; 401/129, 268, 122, 127, 126; 15/188, 207.2, 159, 187
See application file for complete search history.

(56) References Cited

U.S. PATENT DOCUMENTS

| | | | | |
|---|---|---|---|---|
| 3,862,639 | A | 1/1975 | Schefer et al. | |
| 4,403,624 | A | 9/1983 | Montgomery | |
| 4,404,977 | A | 9/1983 | Vasas | |
| 4,635,659 | A * | 1/1987 | Spatz | 132/218 |
| 4,804,004 | A * | 2/1989 | Taylor | 132/218 |
| 5,709,230 | A * | 1/1998 | Miraglia | 132/218 |
| 6,412,496 | B1 | 7/2002 | Gueret | |
| 2005/0115011 | A1 | 6/2005 | Petit | |
| 2008/0219748 | A1 | 9/2008 | Salciarini | |
| 2008/0245382 | A1 | 10/2008 | Marciniak-Davoult | |

FOREIGN PATENT DOCUMENTS

| | | | |
|---|---|---|---|
| EP | 1070466 | A2 | 1/2001 |
| EP | 1607020 | A1 | 12/2005 |
| FR | 2512653 | A1 | 3/1983 |
| FR | 2862193 | A1 | 5/2005 |
| FR | 2912620 | A1 | 8/2008 |
| FR | 2913572 | A1 | 9/2008 |
| GB | 880669 | A | 10/1961 |
| GB | 2074443 | A1 | 11/1981 |
| WO | WO 2007042061 | * | 4/2007 |

OTHER PUBLICATIONS

Translation for WO 2007042061.*

* cited by examiner

*Primary Examiner* — Todd Manahan
*Assistant Examiner* — Brianne O'Neill
(74) *Attorney, Agent, or Firm* — Jacox, Meckstroth & Jenkins

(57) ABSTRACT

The applicator comprises a core presenting at least one helical furrow extending along at least one segment of the core from a first longitudinal end of the segment to a second longitudinal end of the segment. The core has a transverse dimension, measured away from the furrow, that varies on traveling along the segment in a longitudinal direction of the core. The core presents spines formed integrally therewith and situated on the segment outside the furrow.

30 Claims, 9 Drawing Sheets

APPLICATOR FOR MAKING UP THE EYELASHES AND/OR THE EYEBROWS, THE APPLICATOR INCLUDING A FURROW

CROSS-REFERENCE TO RELATED APPLICATIONS

This application is a non-provisional of U.S. Provisional Patent Application Ser. No. 60/950,630 filed Jul. 19, 2007 and also claims priority to French Application No. 0756435 filed Jul. 11, 2007, which applications are incorporated herein by reference and made a part hereof.

FIELD OF THE INVENTION

The invention relates to applicators for applying a substance, such as mascara, to the eyelashes and/or the eyebrows.

BACKGROUND OF THE INVENTION

Such applicators have been proposed for many years in a variety of shapes and configurations, while nevertheless not giving complete satisfaction. It is usually expected that the applicator will perform several functions as well as possible. A first function is a lengthening function. In other words, once they have been made up, the eyelashes could give the impression of being relatively long. A second function is that of imparting volume: applying the substance enables the eyelashes to be given an apparent volume that is greater than their volume when in the bare state. A third function is a curving function that seeks to curve the eyelashes as much as possible. A fourth function is a separation function: the eyelashes need to be made up while being suitably separated from one another without clumping together. It is also desired to obtain a good makeup result while minimizing the number of hand movements, i.e. reducing to a minimum the number of successive passes of the applicator over the same eyelashes. It is also preferable for application to be easy to perform without requiring a very high degree of dexterity on the part of the user. Finally, it is desirable for the applicator to be easy to fabricate.

By way of example, document U.S. Pat. No. 4,403,624 discloses a mascara applicator comprising a core made of plastics material presenting spines that are likewise made of plastics material. However that type of applicator does not produce satisfactory results because of the way in which the core, which is of a tapering shape, becomes filled with makeup.

OBJECTS AND SUMMARY OF THE INVENTION

An object of the invention is thus to provide an applicator that provides a result that is satisfactory in terms of applying makeup by performing actions that are simple and fast, which applicator is also easy to fabricate.

The invention provides several solutions to this problem.

To this end, the invention provides an applicator for applying a substance to the eyelashes and/or to the eyebrows, the applicator comprising a core presenting at least one helical furrow extending over at least a segment of the core from a first longitudinal end of the segment to a second longitudinal end of the segment, the core presenting a transverse dimension measured outside the furrow, that varies on going along the segment in a longitudinal direction of the core.

Advantageously, the applicator has spines made integrally with the core, and/or situated on the segment. The spines may be situated outside the furrow.

The invention also provides an applicator for applying a substance on the eyelashes and/or the eyebrows, the applicator comprising a core presenting at least one furrow and spines situated outside the furrow, together possibly with spines situated in the furrow, the spines being made integrally with the core and presenting free ends that form an envelope surface constituting a surface of revolution about a longitudinal axis of the core.

Preferably, the furrow is helical.

Advantageously, the furrow extends along at least one segment of the core from a first longitudinal end of the segment to a second longitudinal end of the segment, and including spines situated on the segment outside the furrow.

Finally, the invention also provides an applicator for applying a substance to the eyelashes and/or the eyebrows, the applicator comprising a core presenting at least one furrow extending over at least a segment of the core from a first longitudinal end of the core to a second longitudinal end of the core, and spines made integrally with the segment and situated thereon outside the furrow.

Thus, in each of these applicators, the furrow constitutes a zone for storing substance for application. This zone becomes filled with substance when the applicator is in the reservoir, and then is removed from the reservoir without being emptied of its content. When the neck of the reservoir includes a wiper, the wiper does not wipe the inside of the furrow, thereby conserving its storage function. Depending on the shape, dimensions, and arrangement of the furrow(s), it is possible to adjust the extent to which the applicator is filled with substance on leaving the reservoir and to adjust the distribution over the applicator of this load. While applying the makeup, the content becomes emptied progressively from the furrow, in particular because of eyelashes that penetrate into the furrow. The eyelashes are thus suitably covered in substance without it being necessary for the user to refill the applicator frequently by putting it back into the reservoir. The furrow enables the makeup result that is obtained to be improved. Makeup is applied by means of a hand movement that is simple and quick to perform. Finally, making the furrow does not significantly complicate fabricating the applicator.

In addition, in the first above-described applicator of the invention, the helical shape of the furrow, associated with the core having a section that is not constant, enables the load of substance to be distributed over at least a fraction of the length of the applicator, while nevertheless ensuring that the load is not uniform along the length of the applicator and/or circumferentially around its longitudinal axis. As a result, one portion of the applicator carries a greater load of substance than another portion. It is found that such an applicator that is loaded non-uniformly is particularly well suited to the hand movements performed by certain users.

In the second applicator of the invention, the spines enable application of the substance to be improved. With this applicator, the substance passes progressively from the furrow to the spines and them from the spines to the eyelashes. The spines contribute to off-loading the substance from the applicator while enhancing the volume, separation, curving, and lengthening of the eyelashes (or of the eyebrows).

The same applies with the third applicator of the invention, the third applicator also having the advantage of being particularly easy to fabricate because the spines are made integrally with the core.

It is then possible to make provision for the furrow to be rectilinear.

Advantageously, the furrow leaves at least one zone on the core that is not engaged with the furrow.

This zone enables the eyelashes to bear against the core during application, in order to obtain a pronounced curving effect.

Advantageously, the furrow extends over more than one turn or indeed over more than two turns, around a longitudinal axis of the applicator.

Thus, the eyelashes encounter the furrow all around the longitudinal axis of the applicator and possibly over a large portion of the length of the applicator. This enhances penetration of the eyelashes into the furrow and application of the substance it contains.

Advantageously, the furrow presents a profile that is V-shaped, and that is preferably asymmetrical.

This profile has the advantage of presenting two sloping flats against which the eyelashes can bear in order to pick up substance.

Preferably, the furrow presents a section, measured in a meridian plane of a longitudinal axis of the core, that has a maximum dimension that varies, and that preferably decreases, on traveling along the segment towards a free end of the applicator.

This disposition also makes it possible to modulate the loading of substance within the furrow along the applicator. When the section decreases close to the free end, the load of substance in the furrow likewise decreases, with this corresponding to user preferences, since finer application of makeup is generally performed using the free end of the applicator.

Provision can be made for there to be only one furrow, or on the contrary for the core to present a plurality of furrows.

Advantageously, a transverse dimension of the segment decreases on traveling along the segment towards a free end of the applicator.

This reduction enables makeup to be applied more finely by means of the free end zone of the applicator.

Advantageously, a transverse dimension of the segment passes through an extremum, in particular a maximum, on traveling along the segment towards a free end of the applicator.

This arrangement encourages symmetrical distribution of the load of substance on either side of the extremum, which some users find more appropriate.

Preferably, the core and/or the segment present a shape that is conical or frustoconical.

Preferably, there is at least one zone of the applicator, and preferably a proximal end zone, in which the core occupies more than half or even more than three-fourths of a transverse dimension of the applicator.

Also preferably, there is at least one zone, preferably a distal end zone, in which the core occupies less than half, or indeed less than one-fourth, of a transverse dimension of the applicator.

These dimensioning characteristics also have an influence on the distribution of the load of substance on the applicator on leaving the reservoir. When combined with one another, these characteristics enable large contrasts to be achieved in terms of load levels in different portions of the applicator.

Advantageously, the applicator includes a stem carrying the core, the core presenting a transverse dimension that is greater than the transverse dimension of the stem.

Advantageously, the applicator includes an inlet cone, possibly provided with spines.

The core is preferably flexible.

This flexibility is reassuring for the user. It makes the core more supple and thus reduces the risk of hurting the eye with the applicator.

Advantageously, the applicator has spines situated in the furrow.

Advantageously, the applicator has spines situated in the furrow and spines situated outside the furrow.

Provision can be made for the applicator to have spines that form at least one rectilinear row parallel to a longitudinal direction of the core.

Such a row enhances combing of the eyelashes with the applicator.

Provision can also be made for the applicator to have spines forming at least one rectilinear row parallel to a longitudinal direction of the core, and/or a row that is helical in shape.

Such a row makes it easier to separate the eyelashes, in particular when the user is used to turning the applicator while applying the substance.

Advantageously, the applicator has spines disposed in such a manner that at least one transverse dimension of the applicator, as measured between the free ends of the spines, is constant on traveling along at least a portion of the applicator in a longitudinal direction of the core.

As a result the overall size or total dimension of the applicator remains constant, even if the section of the core varies along the applicator, e.g. if it decreases towards the free end. Where appropriate, the variations in the dimensions of the core are then compensated by contrary variations in the length of the spines. The combing function and the separation function are enhanced at those locations where the spines are the longest.

The ends of the spines preferably form an envelope surface constituting a surface or revolution about the longitudinal axis of the core. This surface may be cylindrical or diabolo-shaped, for example.

Advantageously, the applicator has spines disposed in such a manner that at least one transverse dimension of the applicator, as measured between free ends of the spines, increases on traveling along at least a fraction of the applicator towards a free end of the applicator.

This arrangement also enhances the separation and lengthening functions.

Preferably, the applicator includes a one-piece applicator head.

The invention also provides an assembly for applying a substance to the eyelashes and/or the eyebrows, the assembly comprising a reservoir of substance and an applicator of the invention.

Other objects and advantages of the invention will be apparent from the following description, the accompanying drawings and the appended claims.

Finally, the invention provides a use of an applicator of the invention or of an assembly of the invention for making up the eyelashes and/or the eyebrows.

BRIEF DESCRIPTION OF THE DRAWINGS

Other characteristics and advantages of the invention appear further from the description below of various embodiments given as non-limiting examples, in which.

MORE DETAILED DESCRIPTION

Figure 1A:
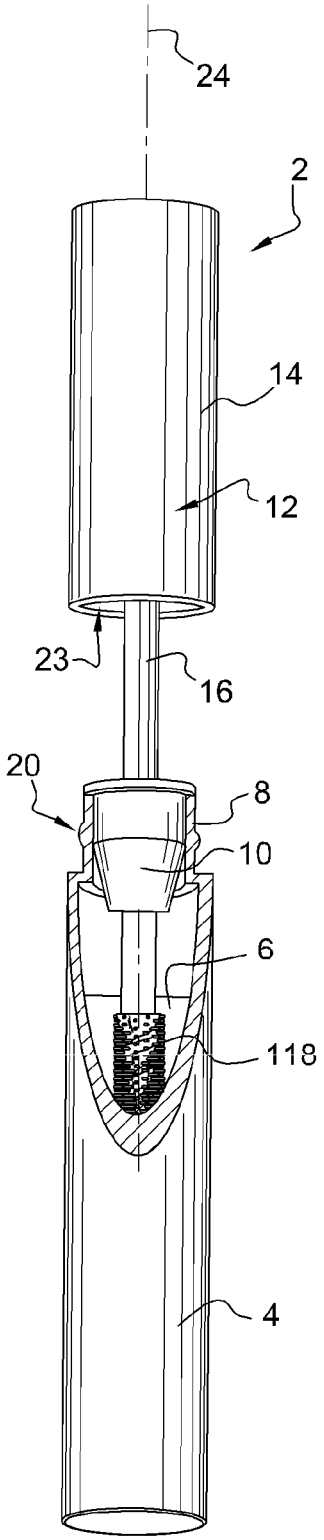
FIG. 1A is a partially cutaway perspective view of a makeup assembly in a first embodiment of the invention.

With reference to FIGS. 1A to 1G, there follows a description of a first embodiment of a makeup assembly for applying makeup to the eyelashes.

The assembly 2 comprises a reservoir 4 containing a substance 6 to be applied. By way of example, the substance could be mascara. The reservoir presents a top portion having an opening defined by a neck 8 containing a wiper 10. The assembly includes an applicator 12 having a handle member 14 fastened to a proximal end of a stem 16, which carries at its distal end an applicator head 118.

On its outside face, the neck 8 presents a thread 20 suitable for co-operating in screw-and-nut engagement with a thread formed in complementary manner on an inside face 23 of the handle member 14. The applicator can thus be screwed onto the reservoir so as to close it. When the applicator is in the closed position on the reservoir, the head 118 is immersed in the mascara 6. When the applicator member is extracted, the stem 16 and then the head 118 are wiped by the wiper 10 in order to eliminate excess substance therefrom.

The reservoir 4 generally constitutes a body of revolution about an axis 24. The same applies to the applicator member 12. In this example, the axis 24 corresponds to the longitudinal direction of the applicator.

There follows a detailed description of the applicator head 118 of the applicator. The head 118 comprises an endpiece 21 for fastening securely to the distal end of the stem 16, e.g. by being plugged therein. This endpiece is extended towards the free end 22 of the applicator by a portion 124 referred to as a "cone", that is of frustoconical shape, flaring towards the free end. Starting from the largest section of the cone 124, there extends the core 126 of the applicator head 118. The endpiece 21, the cone 124, and the core 126 form the body of the applicator head.

The core 126 presents a free end segment 130 that extends over a length laying in the range one-seventh to one-sixth the total length of the core in the present example. Specifically, this segment 130 presents a transverse dimension De, measured in a plane perpendicular to the axis 24, that is constant on going along the segment in the longitudinal direction 24. In the present example, the segment 130 is in the form of a circular section cylinder on the axis 24.

In this example, the remainder of the core 126 is formed by a main segment 132 extending from the proximal end of the end segment 130 to the largest distal end of the cone 124. The main segment 132 presents a transverse dimension Da, measured perpendicularly to the axis 24 that varies on going along the main segment from one of its two longitudinal ends to the other. As explained below, the core also presents a furrow. The dimension Da is measured outside the furrow, at the surface of the core. In the present example, the transverse dimension Da diminishes on going along the main segment 132 towards the free end 122, i.e. from the cone 124 to the end segment 130. In this embodiment, the segment 132 is frustoconical in shape, with the largest section of the segment being that which is contiguous with the cone 124.

It can be seen that the transverse dimensions Da of the core at the proximal end of the segment 132, which in this example is the diameter of the cone 124, is greater than the diameter of the stem 16 and of the endpiece 21.

Specifically, the core 126 presents a helical furrow 134 of axis 24. In this example, there is only one furrow 134. The furrow extends along the entire length of the main segment 132 from its proximal end to its distal end.

Figure 1B:
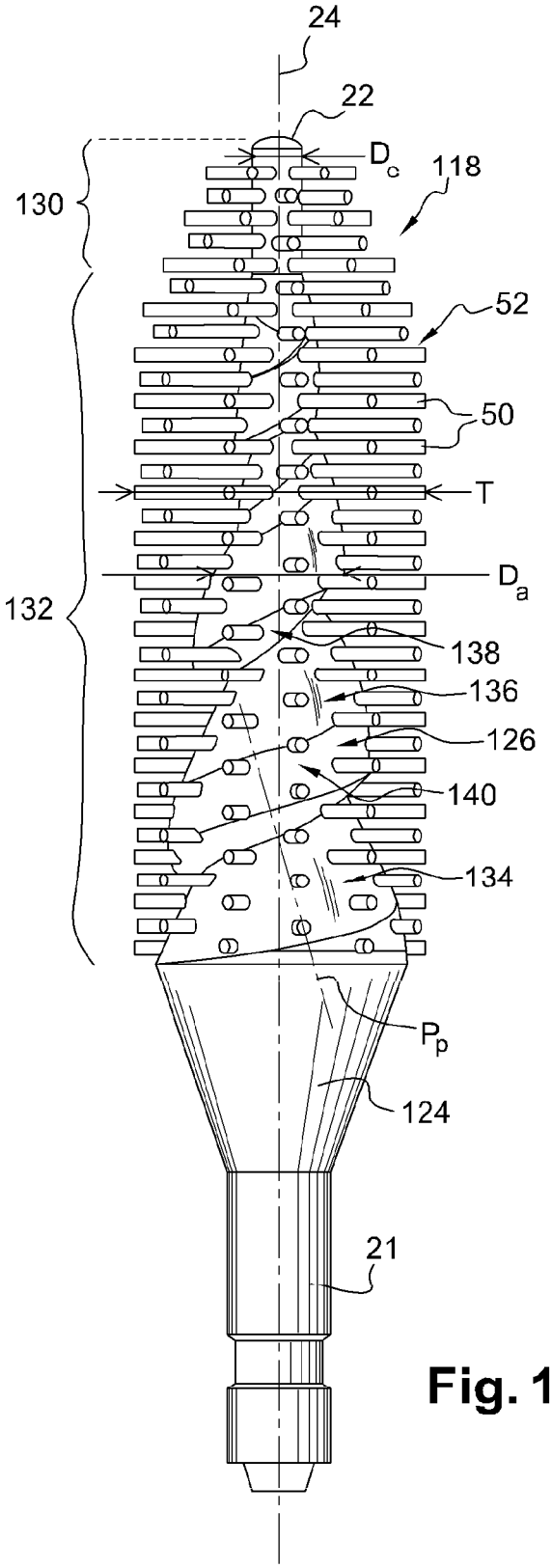
FIGS. 1B, 1C, 1E, and 1G are respectively an elevation view, a perspective view, an end view, and an axial section view of the application head of the applicator of the FIG. 1 assembly.
Figure 1C:
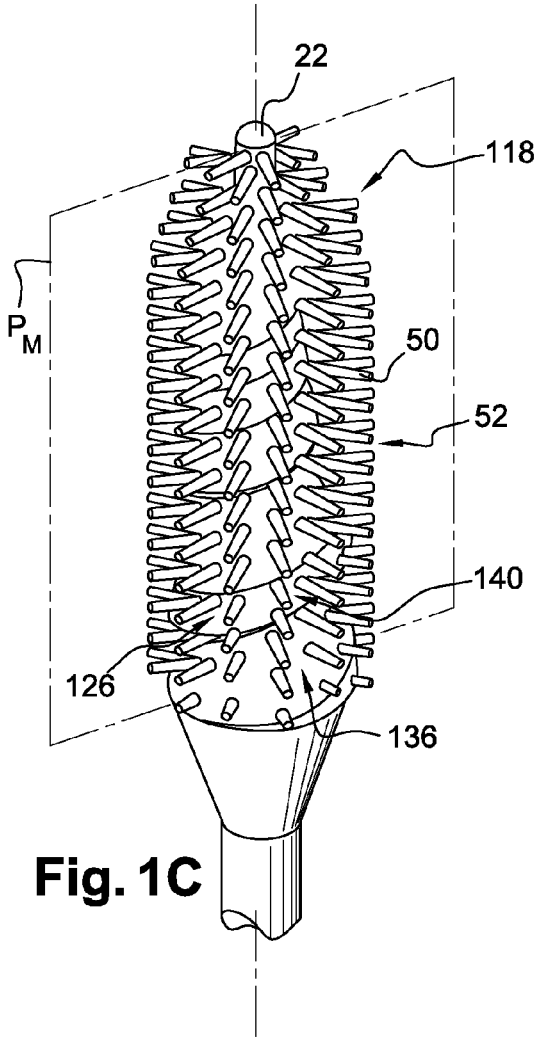
Figure 1D:
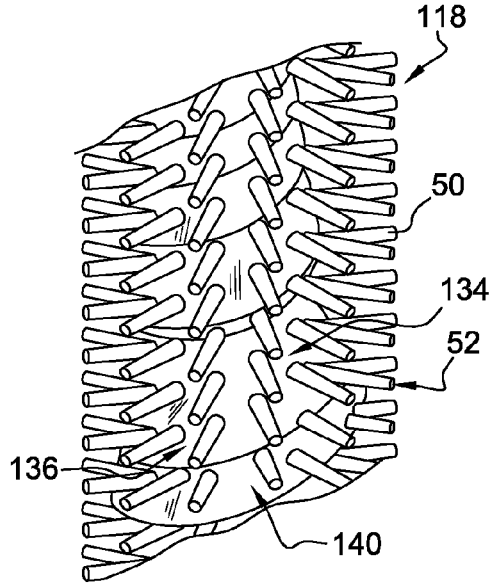
FIG. 1D is a view on a larger scale showing a detail of FIG. 1C.

In this example, the furrow 134 presents a V-shaped profile. This V-shape can be seen in a section of the core on the meridian plane containing the axis 24. The term "meridian" plane is used to designate a radial plane parallel to the axis 24 such as the plane PM shown in FIG. 1C, or the section plane of FIG. 1G. This shape can also be seen in a section of the furrow on a plane PP perpendicular to the longitudinal direction of the furrow. Such a plane PP is inclined relative to the meridian plane passing through the same position. The trace of this plane PP is shown in the plane of FIG. 1B. Specifically, the V-shaped profile is asymmetrical. By specifying that the furrow 134 presents a proximal flank 136 that faces upwards in FIGS. 1B to 1D and that is the flank closer to the cone 124, and a distal flank 138 facing the proximal flank and facing downwards, it can be seen that the proximal flank 136 presents locally an area that is greater than the distal flank 138. In contrast, the flank 136 slopes less relative to the axis 24 than does the flank 138.

The furrow 134 presents a cross-section of greatest dimension that varies on moving along the main segment 132 along the axis 24. More precisely, this section decreases from the proximal end of the segment to its distal end going towards the free end 22 of the applicator. This observation remains true regardless of whether the section is taken in a meridian plane PM as described above or in a plane PP that is locally perpendicular to the longitudinal direction of the furrow.

In the present example, the furrow 134 leaves the core 126 between portions of the furrow 134 with at least one zone 140 that is not engaged with the furrow 134. In this example, the furrow 134 extends over more than one turn and even over more than two turns around the axis 24 since it extends over about three turns. Thus, the zone 140 that is left free likewise presents a helical shape. The core thus does not have any through opening, so the material thereof does not present any discontinuity. The furrow 134 preferably extends over a small number of turns about the axis, e.g. a number that is less than or equal to 10, or possibly 12.

In the present example, the applicator also includes spines 50. Specifically, the spines are made integrally with the core 126 being molded together therewith. It is the entire head 118 that is made as a single piece. In this embodiment, all of the spines 50 are rectilinear in shape and present an orientation that is radial relative to the axis 24. In particular, they all extend in planes that are perpendicular to the axis 24.

Some of the spines 50 are fastened to the zone 140 of the core that lies outside the furrow, while some other ones of the spines are fastened to the core in the furrow 134, either via the flank 136 or via the flank 138. As can be seen in particular in the end view of FIG. 1E, the spines are organized to form rectilinear rows that are parallel to the axis 24, and specifically to form twelve rows. Furthermore, the same spines form helical rows around the axis 24, as can be seen in particular in FIG. 1B.

Figure 1E:
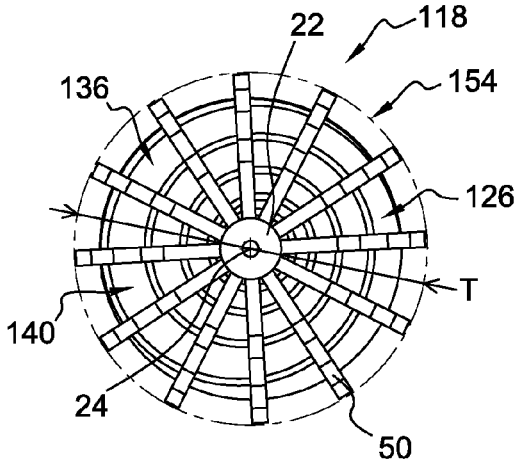

The spines 50 present free ends 52 that together define an envelope surface 154 as shown diagrammatically in FIG. 1E. This surface is in the form of a circular section cylindrical surface of revolution about the axis 24 over the major fraction of the main segment 132, with the exception of a distal end zone of said segment. In this distal end zone, and also in the free end zone 130, the envelope surface 154 presents a frustoconical shape about the axis 24.

It can thus be seen that over the major fraction of the head 118, the total transverse dimension T of the head, as measured between the free end 52 of the spines, is constant on going along the head from the proximal end of the core to a little before the distal end of the main segment 132. This transverse dimension corresponds to the diameter of the envelope surface 154. This same transverse dimension T then decreases going towards the free end 22. Thus, a portion is provided in the end zone of the applicator that is of small diameter, more suitable for making up small eyelashes, in particular those situated in the corners of the eye.

From the above, it can be seen that over the major fraction of the applicator, spines that are relatively short, in particular those situated on the zone 140, are to be found side by side with spines that are relatively long, i.e. those situated in the furrow 134.

In the proximal end zone of the core, the transverse dimension Da thereof is so great that it occupies more than half and even more than three-fourths of the transverse dimension T of the applicator as measured at the free ends of the spines. Conversely, in a distal end zone, and in this example even over about half the length of the applicator head, the transverse dimension Da of the core is such that it occupies less than half or even less that one-fourth of the transverse dimension T of the applicator.

The core 126 can be made of a material that is flexible. Given the decreasing diameter of the core going towards its free end, this flexibility will increase on approaching the free end. This flexibility is reassuring for the user since it reduces any risk of hurting the eye with the applicator. Simultaneously, the applicator remains relatively firm, thus enabling makeup to be applied reliably.

Figure 1F:
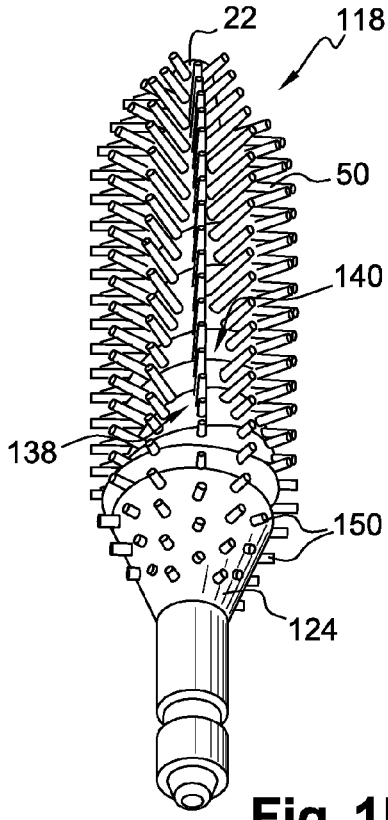
FIG. 1F is another view of the application head showing spines also on the cone.
Figure 1G:
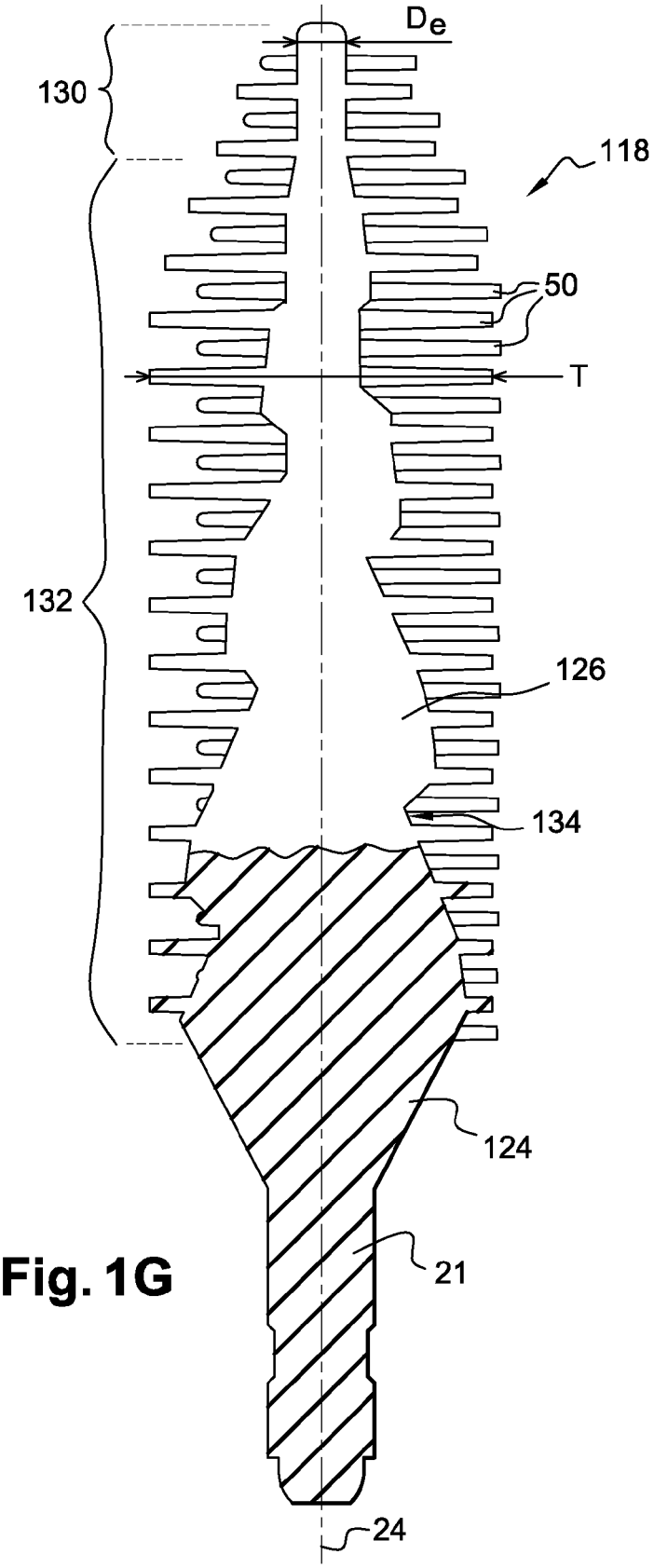

In the variant of FIG. 1F, the applicator head 118 is identical to that described above with the exception that it presents spines 50 also on the cone 124, whereas as the head shown in FIG. 1B has no spines on the cone.

The generally frustoconical shape of the core enables reserves of different quantities of makeup to be created along the core. Thus, where the diameter of the core is relatively large, the reserve of makeup is rather small, thereby increasing the smoothing and lengthening effects of the applicator on the eyelashes. Where the diameter of the core is relatively small, the applicator picks up a larger quantity of makeup. Such zones enable volume to be given to the eyelashes. As a result, by moving the applicator, it is possible to encourage the effect of applying makeup to the eyelashes or the effect of combing them.

The furrow itself also forms reserves of makeup that are somewhat at a distance from the envelope surface of the spines, and thus from the eyelashes.

The generally circular shape lends itself well to the applicator being turned about its axis while applying makeup.

Given that the spines are of mutually different lengths, they are wiped unequally, i.e. the non-wiped length of the spines varies from one spine to another. The wiped length of a spine can thus be adjusted also as a function of the type of wiper used, since the spines are more or less flexible depending on their length, and they therefore push back the wiper to a greater or a lesser extent when the applicator passes through the wiper.

There follow descriptions of other embodiments of the applicator of the invention. The characteristics they have in common with the first embodiment are not described again. Some of the numerical references are increased by 100 on each occasion.

Figure 2A:
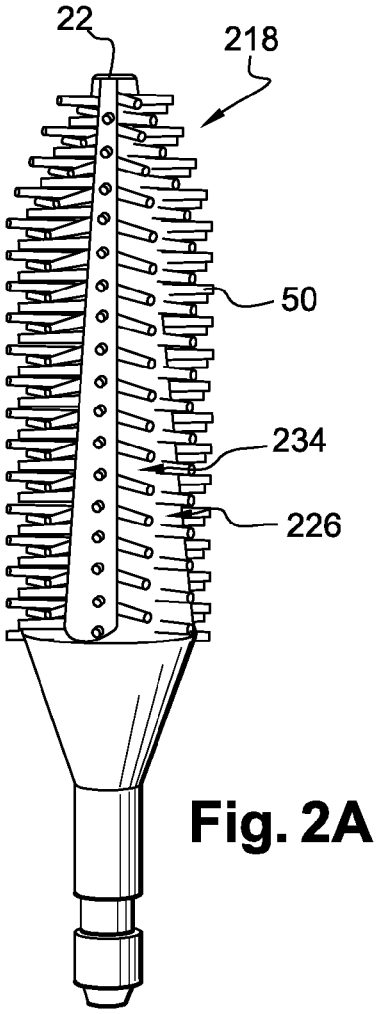
FIGS. 2A and 2C are views analogous to FIGS. 1B and 1E showing a second embodiment of the applicator.
Figure 2B:
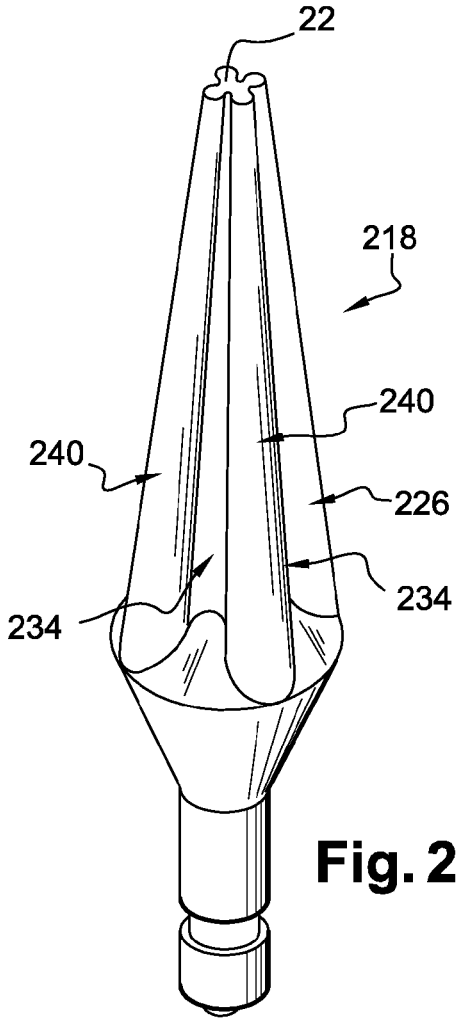
FIG. 2B shows the FIG. 2A applicator without its spines.
Figure 2C:
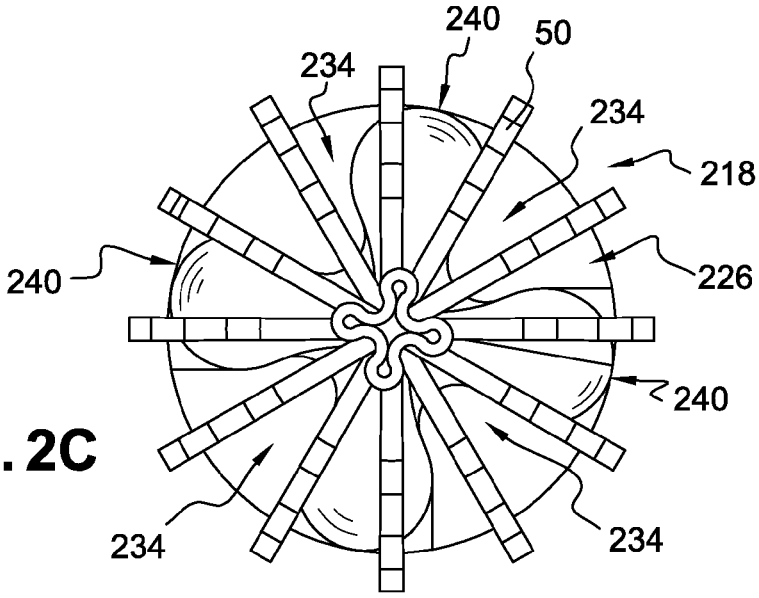

In the second embodiment of the head 218 as shown in FIGS. 2A to 2C, there are a plurality of furrows 234 that are formed in the core 226. In addition, the furrows (four in number in this example) are rectilinear and parallel to the axis 24.

As in the first embodiment, the spines 50 extend in rectilinear rows parallel to the axis 24 and in helical rows around said axis. The rectilinear rows may be located in alternation in the bottoms of the furrows 234 and at the tops of the zones 240 defined between the furrows. Nevertheless, as shown in FIG. 2C, in the present example, the number of rectilinear rows remains unchanged relative to that of the first embodiment, such that some of the rows extend from one or other of the flanks of a furrow. In this example, the furrows present a U-shaped transverse profile with a bottom that is circularly arcuate.

As before, it should be observed that the transverse dimension of the core decreases going towards the free end 22, as does the width of the furrows, whereas the overall size or total dimension of the applicator as measured between the free ends of the spines remains constant over the major fraction of the length of the applicator. The free ends of the spines form an envelope surface constituting a surface of revolution about the longitudinal axis of the core.

Figure 3A:
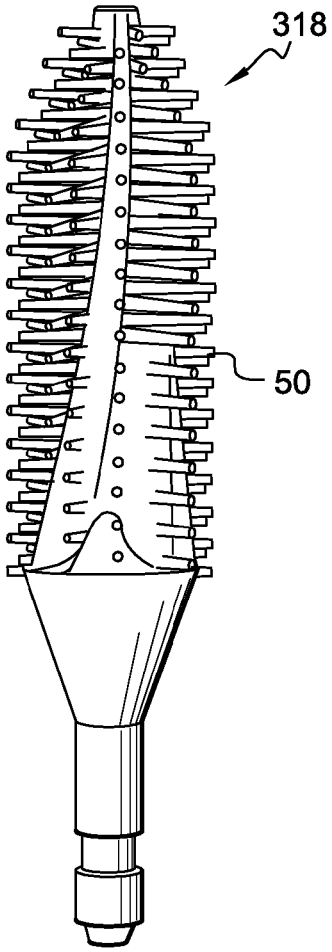
FIGS. 3A to 3C are views analogous to FIGS. 2A to 2C showing a third embodiment of the applicator of the invention.
Figure 3B:
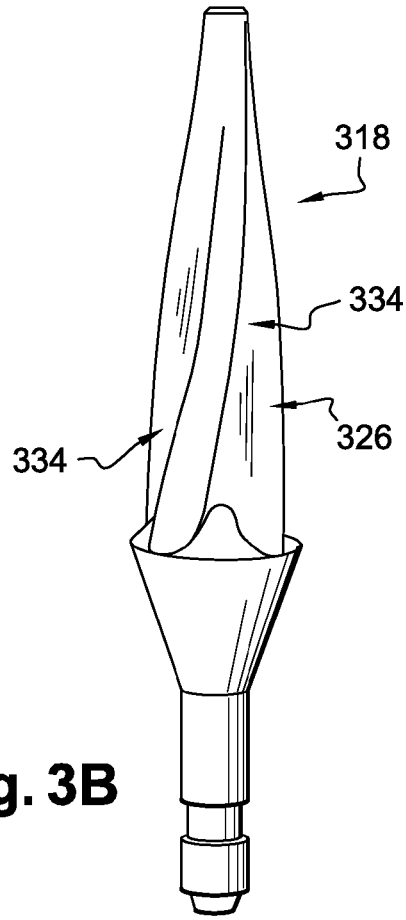
Figure 3C:
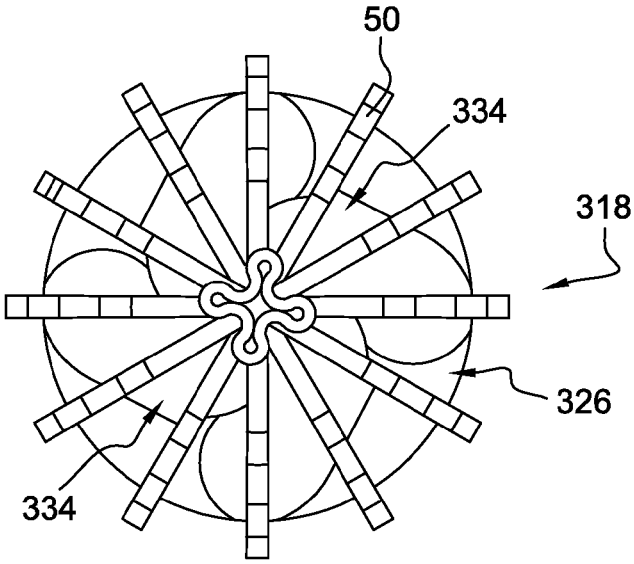

In the third embodiment, the applicator head 318 shown in FIGS. 3A to 3C, the only change compared with the above-described embodiment lies in the shape of the furrows 334. There are likewise four furrows, but in this embodiment they are no longer rectilinear, but return to being helical in shape. Nevertheless, each furrow extends over less than one turn about the longitudinal axis. In the present example, each furrow extends over one-fourth of a turn, giving the core 326 a twisted effect, as shown in FIG. 3B. The spines are placed as above.

Figure 4:
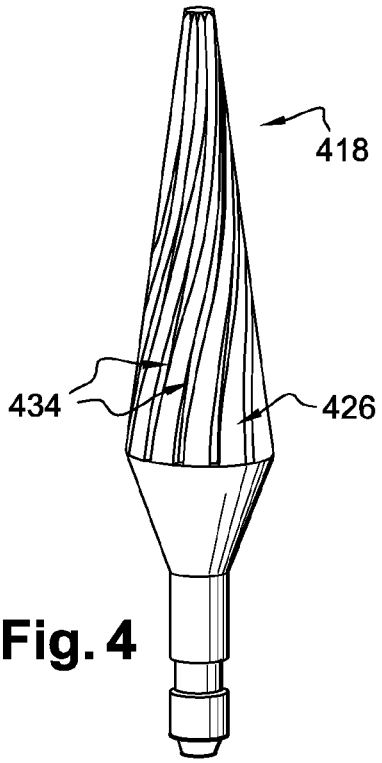
FIGS. 4 to 7 are views analogous to FIG. 2B showing fourth, fifth, sixth, and seventh embodiments, respectively.

In the fourth embodiment shown in FIG. 4, the core 426 of the head 418 presents a greater number of furrows 434, this number being raised to twelve in this example. Once more, the helical furrows extend over a fraction of a turn around the axis. For this embodiment, and also for the embodiments of FIGS. 5 through 7, the spines are not shown, but they are positioned as described above. Specifically, their free ends form an envelope surface in the form of a surface of revolution about the longitudinal axis of the core.

Figure 5:
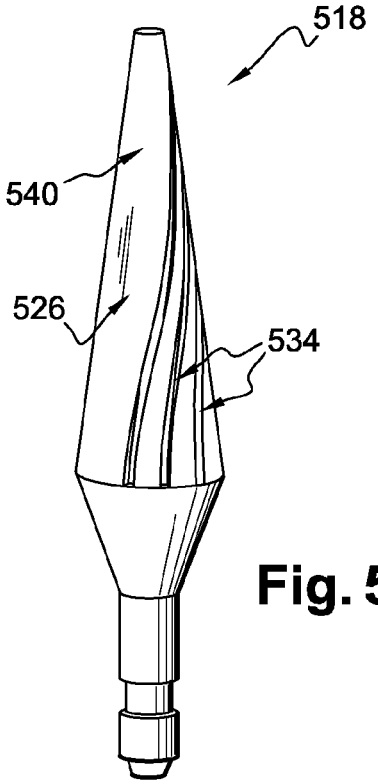

In the fifth embodiment of the head 518 shown in FIG. 5, the furrows 534 form a zone 540 on the core 526 that continuously intercept a plurality of meridian planes including the axis 24. In other words, this zone extends over an entire quarter of the head 518. This embodiment amounts to omitting a series of consecutive furrows from the embodiment shown in FIG. 4. For example, it is possible to retain only half of the furrows.

Figure 6:
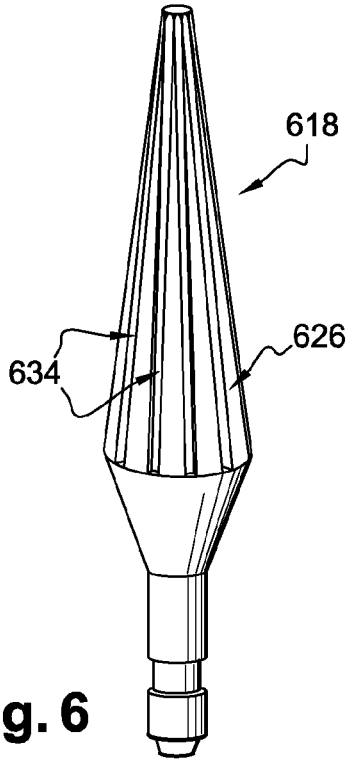

The sixth embodiment of the head 618 as shown in FIG. 6 differs from that of FIG. 4 only by the fact that the furrows 634 of the core 626 are no longer helical, but rectilinear.

Figure 7:
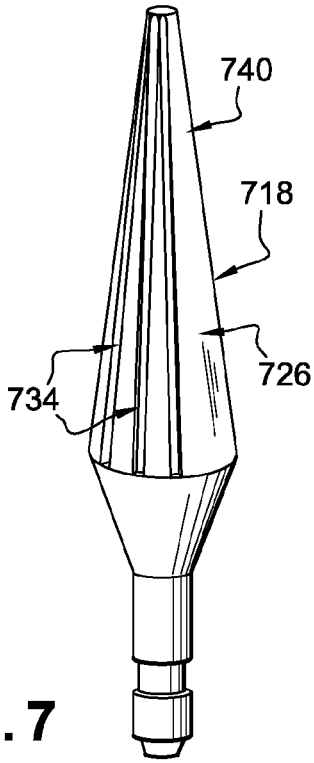

In the seventh embodiment of the head 718 as shown in FIG. 7, only a fraction, e.g. one-half, of the rectilinear furrows 734 of FIG. 6 have been retained so as to leave a zone 740 that is not engaged with any furrow and that continuously intercepts a plurality of meridian planes containing the axis 24 going from the proximal end of the core 726 to its distal end.

Figure 8A:
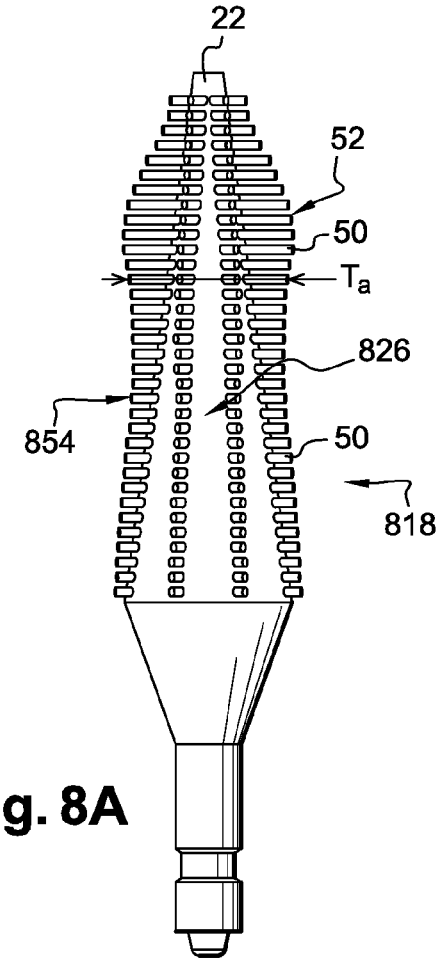
FIGS. 8A and 8B and 9A and 9B are views analogous to FIGS. 1B and 1E showing eighth and ninth embodiments, respectively.
Figure 8B:
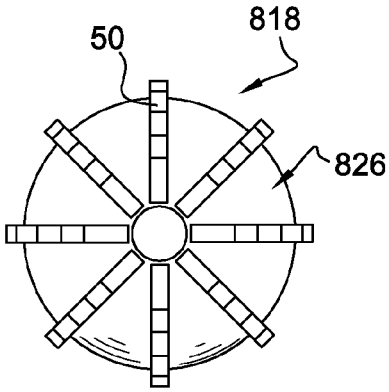

In the eighth embodiment of the head 818 shown in FIGS. 8A and 8B, the core 826 is once again frustoconical in shape. As above, it carries spines 50 that are disposed, in the present example, as eight rectilinear rows parallel to the axis 24 and regularly spaced apart around the axis. The furrows, which in this example are rectilinear, are not shown in order to clarify the figure. This embodiment differs from the above embodiment in particular by the fact that the transverse dimension Ta of the applicator as measured between the free ends 52 of the spines 50 varies, and is even never constant on going along the axis 24 from the proximal end of the core 826 towards the distal end of the applicator. Thus, in the present example, this dimension initially decreases over about the proximal half of the core, and then increases along the third-fourth up to a maximum. Over the last fourth, it finally decreases so as to reach a minimum at the free end 22. This variation in length is the same regardless of the rows used for measuring this dimension. This provides convex and concave zones in the envelope surface 854 that facilitates applying makeup to small or large regions of the eyelashes. Over the first three-fourths of the core that form the main segment, the envelope surface of the spines constitutes a surface of revolution and is generally diabolo-shaped.

Figure 9A:
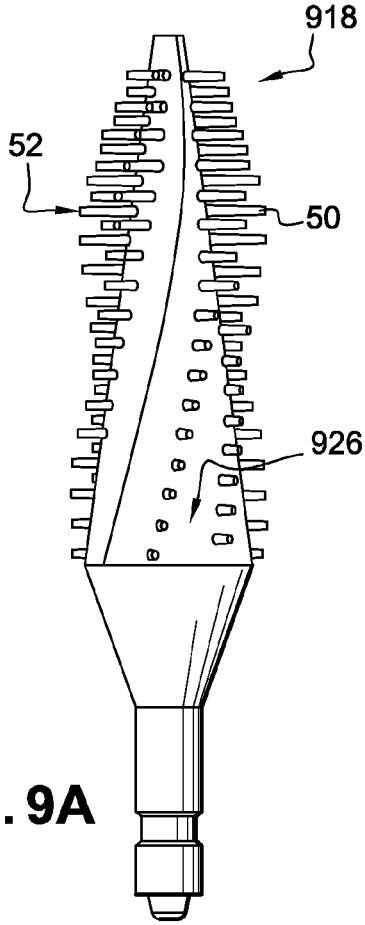
Figure 9B:
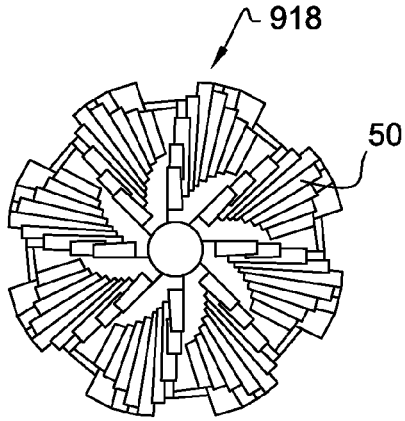

In the ninth embodiment of the head 918 shown in FIGS. 9A and 9B, there can be seen the same variation in the total transverse dimension Ta of the applicator as described above for the eighth embodiment. Nevertheless, unlike the eighth embodiment, the rows of spines 50 are not rectilinear, the arrangement showing helical rows that specifically follow the twist obtained in the core 926 by helical furrows that are not shown. The free ends of the spines continue to form an envelope surface that is a surface of revolution about the longitudinal axis of the core.

Figure 10A:
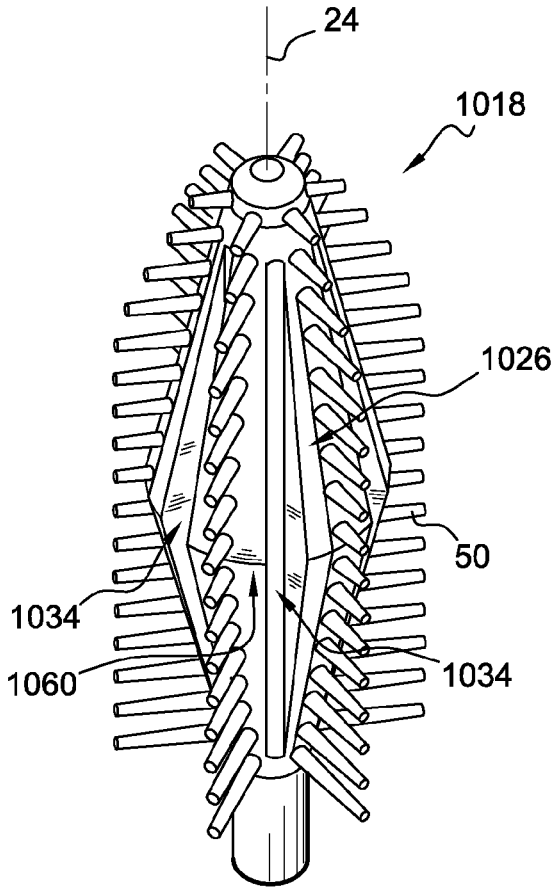
FIGS. 10A and 10B are views analogous to FIGS. 1C and 1E showing a tenth embodiment.
Figure 10B:
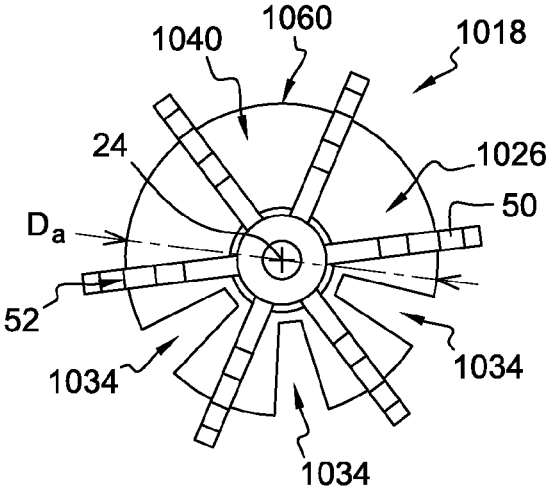

In the tenth embodiment of the head 1018 shown in FIGS. 10A and 10B, the transverse dimension Da of the core 1026 passes through an extremum, in this embodiment a maximum, when going along the core from its proximal end to its distal end. In the present example, this extremum is situated halfway between the two ends and it forms a circular ridge 1060 that is nevertheless interrupted by the furrows 1034. Thus, there can be seen on the core respectively before and after the ridge a frustoconical proximal portion of cross-section that flares towards the free end, followed by a likewise frustoconical distal portion of section that varies in the opposite direction, i.e. that tapers.

Three furrows 1034 are formed in the core in this embodiment, all three of them being rectilinear and parallel to the axis 24. Each of them presents a U-shaped profile with a flat bottom. The three furrows are formed in the same half of the core where this half is defined by intercepting the core on a plane containing its axis 24. The other half defines a zone 1040 that is left free of furrows.

These spines 50 are distributed in rectilinear rows that are parallel to the axis. The envelope surface defined by the free ends 52 of the spines once again presents a shape of the same type as that shown in FIG. 1B, defining a surface of revolution about the longitudinal axis of the core. It can be seen that the distance between the bottoms of the furrows and the axis 24 is constant along the entire length of each furrow, such that the furrows present greater depth in the vicinity of the ridge 1060.

Figure 11A:
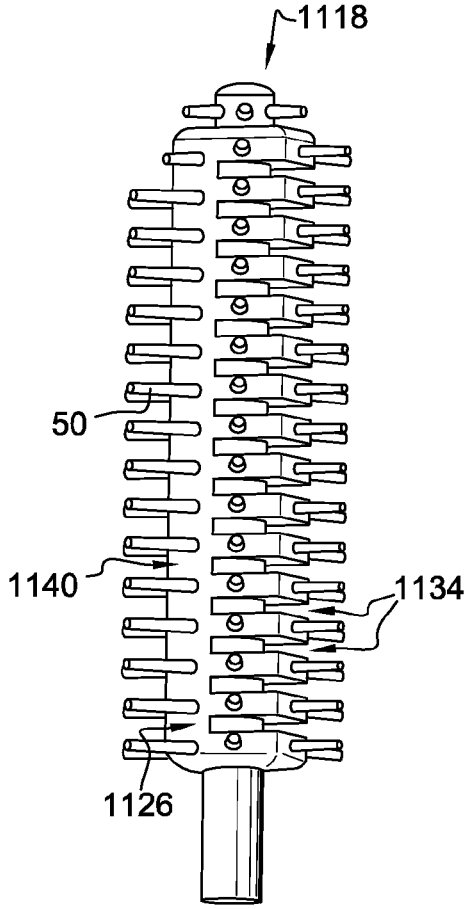
FIGS. 11A and 11B are views analogous to FIGS. 1B and 1E showing an eleventh embodiment.
Figure 11B:
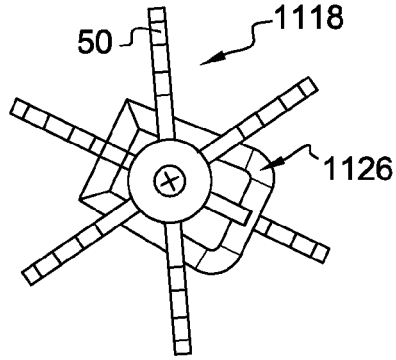

In the eleventh embodiment shown in FIGS. 11A and 11B, the furrows 1134 are each disposed in a plane perpendicular to the axis 24. In addition, the core 1126 has a tapering shape of trapezoidal section in a plane perpendicular to the axis 24. The arrangement of the spines is the same as in FIG. 1B except that all of the spines extend from outside the furrows. The free zone 1140 covers half of the head 1118. The free ends of the spines form an envelope surface that is a surface of revolution about the longitudinal axis of the core.

Figure 12:
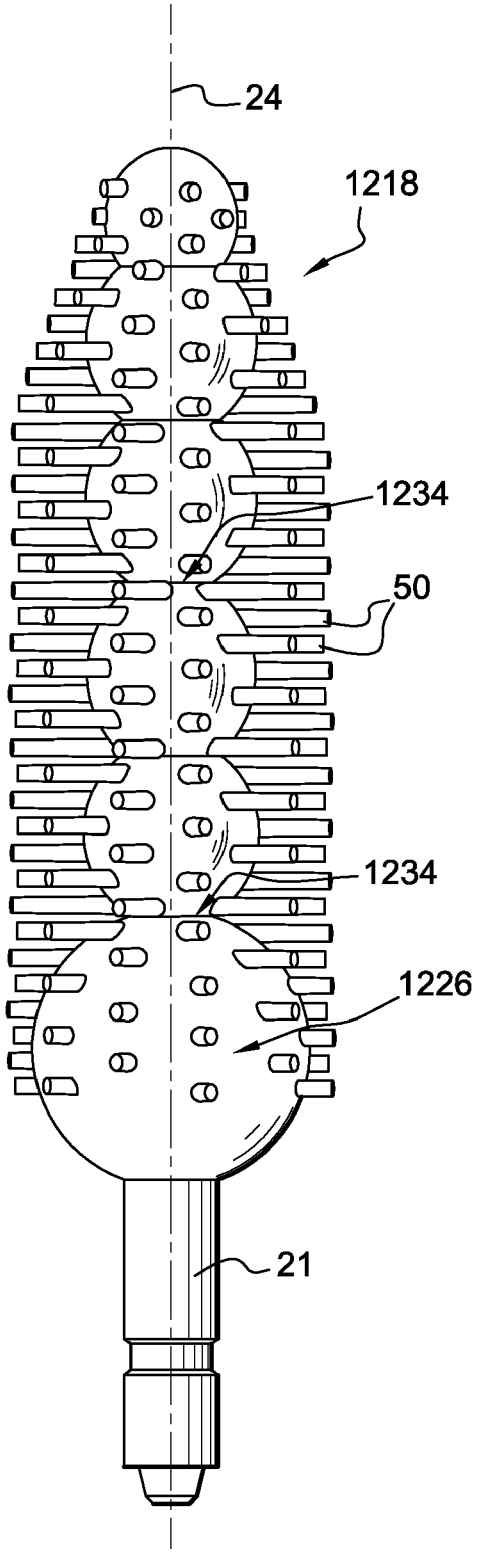
FIGS. 12 and 13 are views analogous to FIG. 1B showing respectively twelfth and thirteenth embodiments.

In the twelfth embodiment shown in FIG. 12, the furrows 1234 are once again located in planes perpendicular to the axis 24, and they are annular in shape, being arranged to give the core 1226 a configuration like a stack of balls. There can be seen six balls, with the largest-diameter ball taking the place of the cone 124 of the embodiment of FIG. 1B, such that it is contiguous with the endpiece 21. The five following balls of smaller diameter all have substantially the same diameter as one another. The configuration of the spines 50 on the head 1218 is the same as in the first embodiment.

Figure 13:
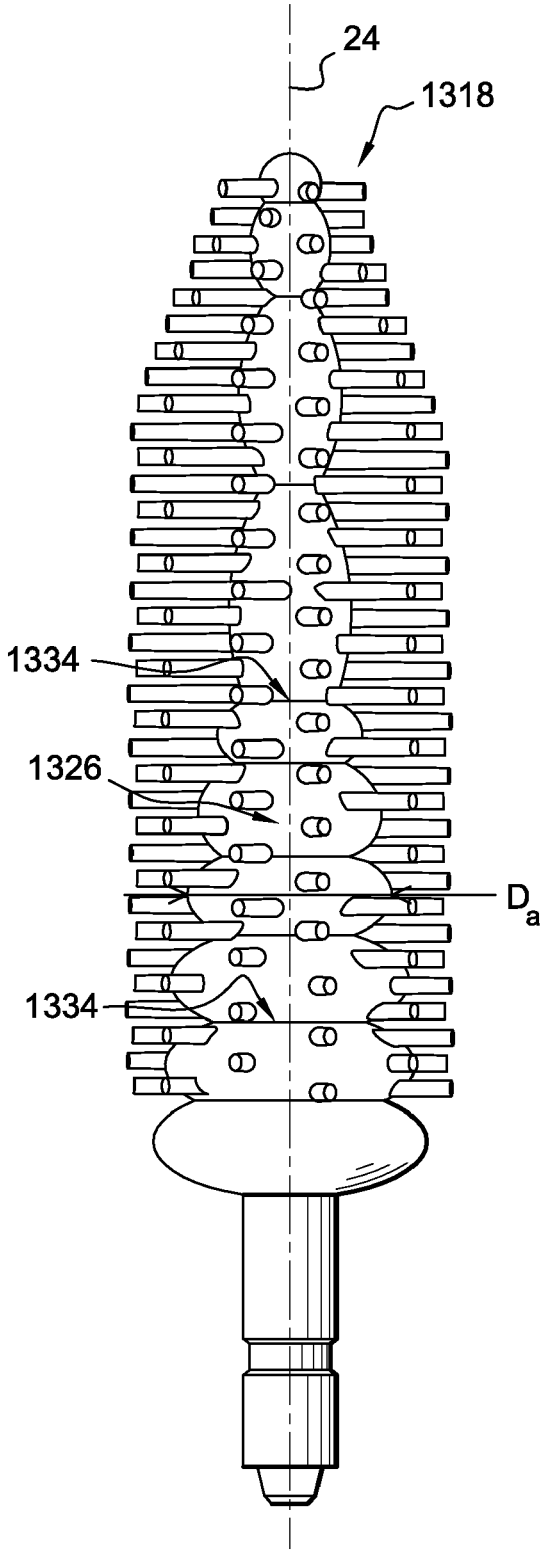

In the thirteenth embodiment of the head 1318 in FIG. 13, the balls forming the core 1326 are eleven in number and they are likewise separated by furrows 1334. The seven balls close to the endpiece present a flattened or pebble shape along the axis 24 such that their extent along the axis 24 is less than their diameter Da perpendicular to the axis. The third ball starting from the free end is, on the contrary, elongate along the axis, such that its axial length is greater than its diameter Da. The other three balls are spherical. The respective diameters Da (perpendicular to the axis) of all of the balls are likewise different from one another. It can be seen that the diameter Da of the balls decreases going from the endpiece to the free end. The proximal ball contiguous with the endpiece 21 does not have any spines, unlike the other balls.

In these last two embodiments, there can be seen a configuration in which the transverse dimensions Da of the core varies on going along the core from its proximal end to its distal end along the axis 24. The number of annular furrows is preferably less than or equal to 10 or 12. The free ends of the spines likewise form an envelope surface that constitutes a surface of revolution about the longitudinal axis of the core.

The applicator of the invention enables the eyelashes and the eyebrows to be made up, in particular by passing the applicator along the eyelashes or the eyebrows. This movement may be accompanied by a movement of turning the applicator about its axis 24.

The applicator head may be made by injection-molding a material such as fluorinated thermoplastic elastomer (TPE-F) of the SEBS type (having a copolymer with ethylene, butylene, and styrene blocks), a vulcanized thermoplastic elastomer of the olefin type (TEP-O) of the ethylene, propylene, diene monomer type (EPDM), or indeed a urethane type thermoplastic elastomer (TPE-U). It may be made of polypropylene, polyamide, or indeed of an elastomer. The core is preferably made to have a section that is solid, i.e. without any internal cavity. It is also possible to choose to make the applicator out of two materials, e.g. by dual injection of two materials. It is possible to select a core material presenting hardness lying in the range 50 to 100 on the Shore scale, preferably in the range 65 to 85, e.g. equal to about 75 on the Shore scale.

In certain embodiments, provision can be made for the spines not to be made integrally with the core but to be fitted thereto. The spines could be replaced by natural or synthetic fibers, e.g. secured by flocking.

The applicator may present a generally curved shape, so that its axis 24 is curved.

Naturally, numerous modifications could be made to the invention without going beyond the ambit thereof.

Provision could be made for the applicator to present a main segment comprising:

a portion provided with one or more helical furrows; and another portion provided with one or more furrows that are longitudinal and/or annular.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims.

What is claimed is:

1. An applicator for applying a substance to the eyelashes and/or the eyebrows, said applicator comprising:

a core presenting at least one furrow extending in the core over at least a segment of said core from a first longitudinal end of said segment to a second longitudinal end of said segment:

first spines made integrally with said segment and situated thereon outside said at least one furrow; and second spines situated in said at least one furrow.

2. An applicator according to claim 1, presenting a transverse dimension measured outside said at least one furrow that varies on going along said core in a longitudinal direction of said core.

3. An applicator according to claim 1, in which said at least one furrow is rectilinear.

4. An applicator according to claim 1, in which said at least one furrow leaves at least one zone on said core that is not engaged with said at least one furrow.

5. An applicator according to claim 1, in which said at least one furrow extends over more than one turn, indeed over more than two turns, around a longitudinal axis of said applicator.

6. An applicator according to claim 1, in which said at least one furrow presents a profile that is V-shaped, and that is preferably asymmetrical.

7. An applicator according to claim 1, in which said at least one furrow presents a section, measured in a meridian plane of a longitudinal axis of the core, that has a maximum dimension that varies, and that preferably decreases on traveling along said segment towards a free end of said applicator.

8. An applicator according to claim 1, in which said at least one furrow is a single furrow.

9. An applicator according to claim 1, in which said core presents a plurality of furrows.

10. An applicator according to claim 1, in which a transverse dimension of said segment decreases on traveling along said segment towards a free end of said applicator.

11. An applicator according to claim 8, in which a transverse dimension of said segment passes through an extremum, in particular a maximum, on traveling along said segment towards a free end of said applicator.

12. An applicator according to claim 1, in which said core and/or said segment present a shape that is conical or frustoconical.

13. An applicator according to claim 1, in which there is at least one zone of said applicator, and preferably a proximal end zone, in which said core occupies more than half or even more than three-fourths of a transverse dimension of said applicator.

14. An applicator according to claim 1, in which there is at least one zone, preferably a distal end zone, in which said core occupies less than half, or indeed less than one-fourth, of a transverse dimension of said applicator.

15. An applicator according to claim 1, in which said applicator includes a stem carrying the core, said core presenting a transverse dimension that is greater than said transverse dimension of said stem.

16. An applicator according to claim 1, including an inlet cone.

17. An applicator according to claim 1, in which said core is flexible.

18. An applicator according to claim 1, having a plurality of at least one of said first spines and/or said second spines forming at least one rectilinear row parallel to a longitudinal direction of said core, and/or a row that is helical in shape.

19. An applicator according to claim 1, having a plurality of at least one of said first spines and/or said second spines disposed in such a manner that at least one transverse dimension of said applicator, as measured between the free ends of said plurality of at least one of said first spines and/or said second spines, is constant on traveling along at least a portion of said applicator in a longitudinal direction of said core.

20. An applicator according to claim 1, having a plurality of at least one of said first spines and/or said second spines disposed in such a manner that at least one transverse dimension of said applicator, as measured between free ends of said plurality of at least one of said first spines and/or said second spines, increases on traveling along at least a fraction of the applicator towards a free end of said applicator.

21. An applicator according to claim 1, including a one-piece applicator head.

22. An assembly for applying a substance to the eyelashes and/or the eyebrows, said assembly comprising a reservoir of substance and an applicator according to claim 1.

23. The use of an applicator according to claim 1, to apply makeup to the eyelashes and/or the eyebrows.

24. The applicator as recited in claim 16, wherein said inlet cone comprises at least one spine.

25. A method comprising the steps of:

providing an assembly according to claim to 22; and enabling a user to apply makeup to the eyelashes and/or the eyebrows using the assembly.

26. An applicator according to claim 1 having a plurality of said first spines and/or said second spines presenting free ends that form an envelope surface constituting a surface of revolution about a longitudinal axis of said core.

27. An applicator according to claim 1, in which said at least one furrow is helical.

28. An applicator for applying a substance to the eyelashes and/or the eyebrows, said applicator comprising:

a core presenting at least one furrow extending in the core over at least a segment of said core from a first longitudinal end of said segment to a second longitudinal end of said segment, said at least one furrow presenting a profile that is V-shaped;

spines situated in said at least one furrow; and spines made integrally with said segment and situated thereon outside said at least one furrow.

29. An applicator according to claim 28 in which the profile of said at least one furrow is asymmetrical.

30. A method comprising the steps of:

providing an assembly according to claim 28; and enabling a user to apply makeup to the eyelashes and/or the eyebrows using the assembly.

* * * * *

UNITED STATES PATENT AND TRADEMARK OFFICE

CERTIFICATE OF CORRECTION

PATENT NO. : 8,091,566 B2
APPLICATION NO. : 12/170650
DATED : January 10, 2012
INVENTOR(S) : Christian Salciarini It is certified that error appears in the above-identified patent and that said Letters Patent is hereby corrected as shown below:

In column 2, line 58, delete “them”, and insert --then-- therefor.

In column 11, line 52, delete “8”, and insert --1-- therefor.

Signed and Sealed this
Seventh Day of August, 2012

David J. Kappos

David J. Kappos
*Director of the United States Patent and Trademark Office*